US010168129B2

(12) United States Patent
Brune

(10) Patent No.: US 10,168,129 B2
(45) Date of Patent: Jan. 1, 2019

(54) TARGET PIVOT ASSEMBLY

(71) Applicant: Challenge Targets, LLC, Fort Thomas, KY (US)

(72) Inventor: Bradley T. Brune, Fort Thomas, KY (US)

(73) Assignee: Challenge Targets, LLC, Fort Thomas, KY (US)

( * ) Notice: Subject to any disclaimer, the term of this patent is extended or adjusted under 35 U.S.C. 154(b) by 0 days.

(21) Appl. No.: 15/979,540

(22) Filed: May 15, 2018

(65) Prior Publication Data

US 2018/0340759 A1 Nov. 29, 2018

Related U.S. Application Data

(60) Provisional application No. 62/511,528, filed on May 26, 2017.

(51) Int. Cl.
*F41J 7/04* (2006.01)
*F41J 1/10* (2006.01)

(52) U.S. Cl.
CPC ... *F41J 7/04* (2013.01); *F41J 1/10* (2013.01)

(58) Field of Classification Search
CPC ..... F41J 7/04; F41J 1/10
USPC ..... 273/390–392, 403–410
See application file for complete search history.

(56) References Cited

U.S. PATENT DOCUMENTS

| | | | | |
|---|---|---|---|---|
| 4,706,963 | A * | 11/1987 | Geuss | B25B 5/003 250/495.1 |
| 6,779,797 | B1 * | 8/2004 | Chou | F41J 7/04 273/391 |
| 6,994,348 | B2 | 2/2006 | Lambert et al. | |
| 6,994,349 | B2 | 2/2006 | Lambert et al. | |
| 7,128,321 | B1 * | 10/2006 | Brown | F41J 5/18 273/392 |
| 7,219,897 | B2 | 5/2007 | Sovine et al. | |
| 8,684,361 | B2 | 4/2014 | Henson et al. | |
| 9,631,906 | B2 * | 4/2017 | English | F41J 5/052 |
| 9,784,538 | B2 * | 10/2017 | Sovine | F41J 1/10 |
| 9,927,214 | B2 * | 3/2018 | Cote | F41J 1/10 |
| 9,927,216 | B2 * | 3/2018 | Anderson | F41J 7/04 |
| 10,001,349 | B2 * | 6/2018 | Cote | F41J 1/10 |
| 2006/0125185 | A1 * | 6/2006 | Rolfe | F41J 7/04 273/390 |
| 2008/0185786 | A1 * | 8/2008 | Loveland | F41J 7/04 273/391 |

(Continued)

*Primary Examiner* — Mark Graham
(74) *Attorney, Agent, or Firm* — Wood Herron & Evans LLP

(57) ABSTRACT

The invention is a pivot support assembly for a bullet impact target. It includes a first plate and a second plate, the second plate having a pair of spaced-apart elongated slots formed therein. A pair of pivot support plates each have an extension portion sized to extend through one of the elongated slots and a base portion sized not to fit through the slot. Each of the extension portions including a pivot axis means. A clamp means secures the first and second plates together in a substantially parallel relationship. The extension portions of the pivot support plates are positioned through the slots such that the pivot axis means of each are substantially axially aligned with each other, the base portion is clamped between the first and second plates, and a bullet resistant target plate is supported for pivotal movement on the pivot axis means.

6 Claims, 6 Drawing Sheets

(56) References Cited

U.S. PATENT DOCUMENTS

| | | | | |
|---|---|---|---|---|
| 2012/0205870 | A1* | 8/2012 | Saunders | F41J 7/04 273/392 |
| 2013/0106059 | A1* | 5/2013 | Larue | F41J 1/10 273/407 |
| 2015/0268013 | A1* | 9/2015 | Heise | F41J 7/04 273/389 |
| 2016/0209184 | A1 | 7/2016 | Anderson et al. | |
| 2018/0087881 | A1* | 3/2018 | Bickel | F41J 7/04 |

* cited by examiner

TARGET PIVOT ASSEMBLY

RELATED APPLICATIONS

This application claims priority to U.S. Provisional Patent Application No. 62/511,528, filed May 26, 2017, and incorporates the same herein by reference.

TECHNICAL FIELD

This invention relates to a pivot support assembly for use in a bullet impact target made of hardened steel.

BACKGROUND

A wide variety of reactive metal (i.e., steel) targets are known for firearms training and competition. Such targets are "reactive" in that an impacted target surface may be moved by the force of a bullet impact or produce a distinct audible response from the bullet impact.

Many of these targets include an impact plate or paddle that swings or pivots on an either substantially vertical or horizontal axis. Examples include a swinging plate that pivots on a horizontal axis and returns by gravity to its original position after impact, a falling plate that is knocked down by bullet impact and then may be manually pivoted on a horizontal axis back to its original position, or a target impact paddle that swings along a substantially vertical axis from left to right when struck by a bullet.

Such targets cost more to manufacture (and purchase) than simple paper targets and are, therefore, expected to last through many uses. Soft or ductile steel may be used with small caliber bullets, but quickly will be perforated, dented, or distorted by larger caliber, higher velocity rifle bullet impacts. For this reason, hardened armor plate steel is often used for constructing durable reactive targets that will last for many thousands of rounds of use. Hardened steel, such as AR500, can be cut in a variety of ways. Drilling or cutting a round or polygonal hole in the hardened steel plate does not weaken the remaining metal. However, welding hardened steel or heating it to allow bending causes the metal to anneal, increasing its ductility and reducing its hardness, which results in a significant loss of durability.

SUMMARY OF THE INVENTION

The present invention provides a pivot assembly for use in bullet targets without the use of welding or bending.

The present invention includes a pivot support assembly having a first plate and a second plate. The second plate has a pair of spaced-apart elongated slots formed therein. A pair of pivot support plates each having an extension portion sized to extend through one of the elongated slots and a base portion sized not to fit through the slot, each of the extension portions including a pivot axis means, which can be axially aligned openings. A clamp means, such as threaded fasteners, secures the first and second plates together in a substantially parallel relationship. The extension portions of the pivot support plates are positioned through the slots such that the pivot axis means of each are substantially axially aligned with each other, the base portion is clamped between the first and second plates, and a bullet resistant target plate is supported, such as on an axle, for pivotal movement on the pivot axis means.

The first plate may be a bullet impact panel made of hardened steel. A mounting support member can be used, having a portion that is clamped between the first and second plates.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various figures of the drawings, wherein.

DETAILED DESCRIPTION

Figure 1:
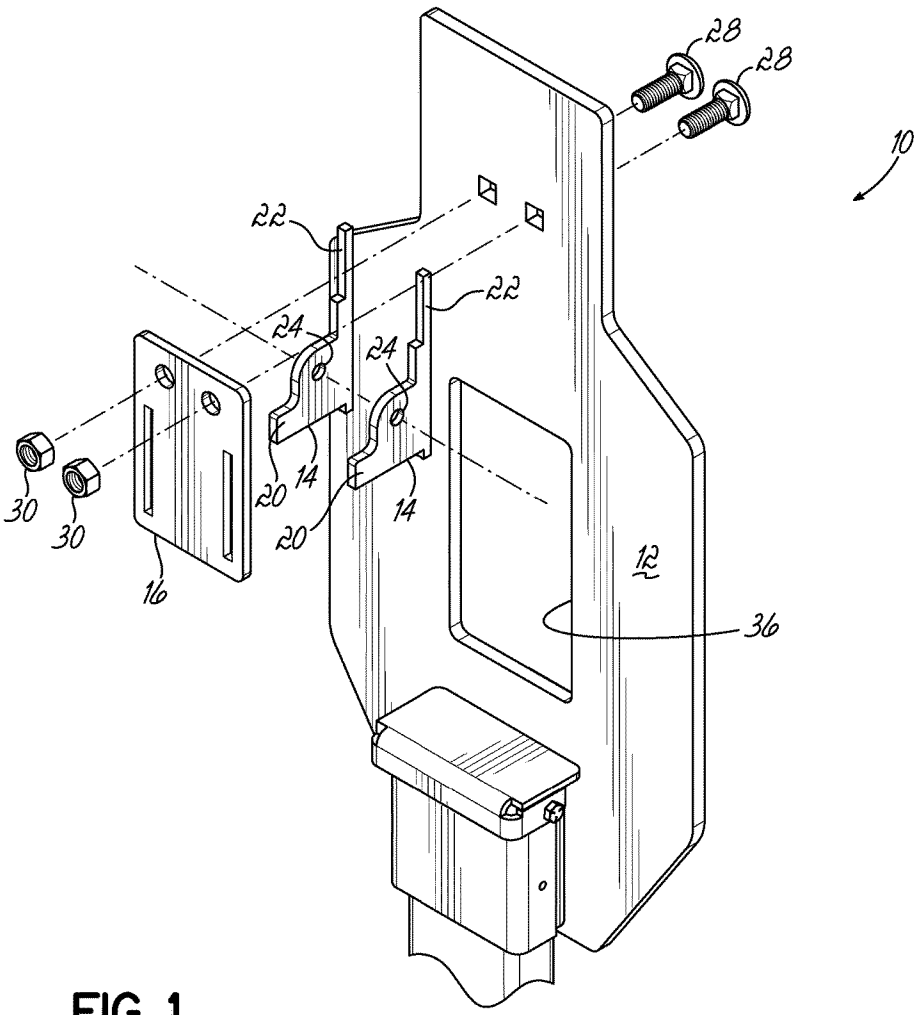
FIG. 1 is an exploded isometric view of the rear side of a target including a pivot assembly according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

The present invention can take on many different forms and may be used in many different applications for providing a pivot assembly to which a pivoting target panel or paddle is attached for movement about either a substantially vertical or horizontal pivot axis. It is intended, therefore, that the present invention be considered a pivot assembly that can be made without welding or bending, including from hardened steel, which can be implemented in different types of reactive bullet targets that are both durable and cost-effective to manufacture and assemble.

FIG. 1, therein is shown at 10 a target in which an embodiment of the pivot assembly of the present invention may be employed. The target 10 includes a front plate 12 made, for example, of hardened steel of sufficient thickness to resist repeated impact from rifle bullets. A pair pivot plates 14 and clamp plate 16 are also provided. The clamp plate 16 includes a pair of spaced apart elongated slots 18. Each of the pivot plates 14 has an extension portion 20 that is sized to extend and pass through one of the elongated slots 18 in the clamp plate 16. Each pivot plate 14 also includes a base portion 22 that extends beyond the length the slot 18 to prevent complete passage of the pivot plate 14 therethrough. Each extension portion 20 includes a pivot axis means, in this case in the form of axially aligned openings 24. The axially aligned openings 24 are sized and positioned to receive a pivot pin, such as a clevis pin 26 (shown in FIGS. 2 and 3). Alternately, the pivot access means could be a fixed rod (not shown) to which a pivoting target plate can be mounted.

To attach the pivot plates 14 to the front plate 12 without welding, the clamp plate 16 is attached to the front plate 12 with the extension portions 20 of the clamps 16 extending through the elongated slots 18 to sandwich the base portions 22 of the pivot plates 14 in place. The clamp plate 16 can be held in place by means of, for example, carriage bolts 28 and locking nuts 30.

Figure 2:
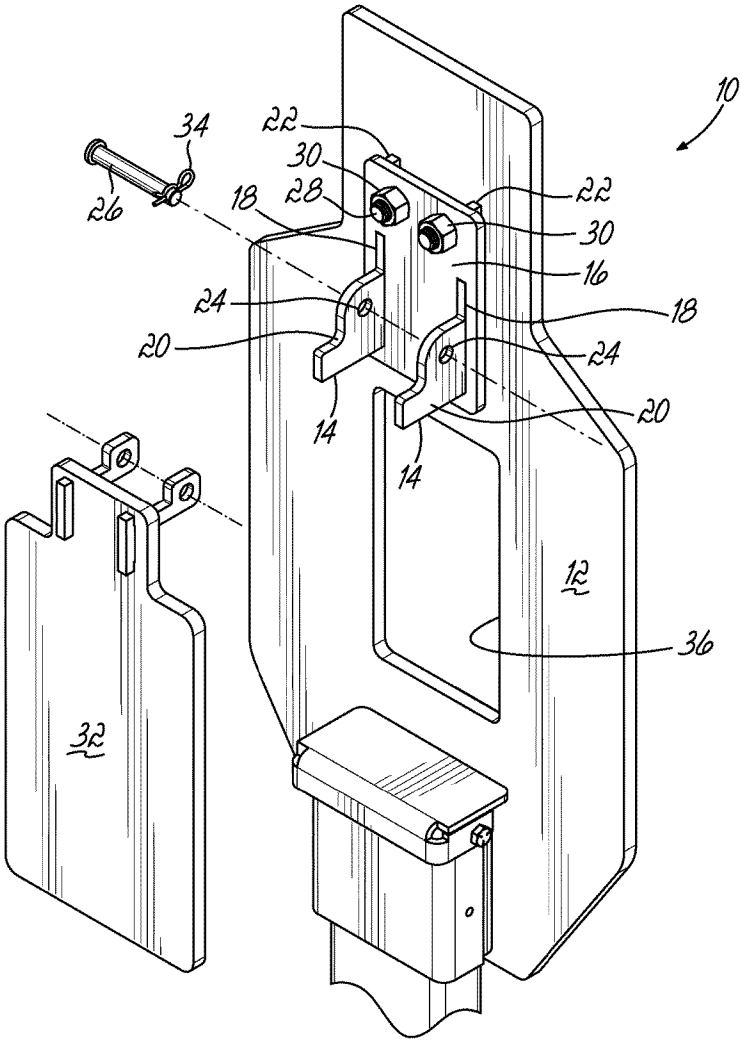
FIG. 2 is another isometric exploded view thereof showing assembly of a moveable target paddle being attached to the pivot assembly.
Figure 3:
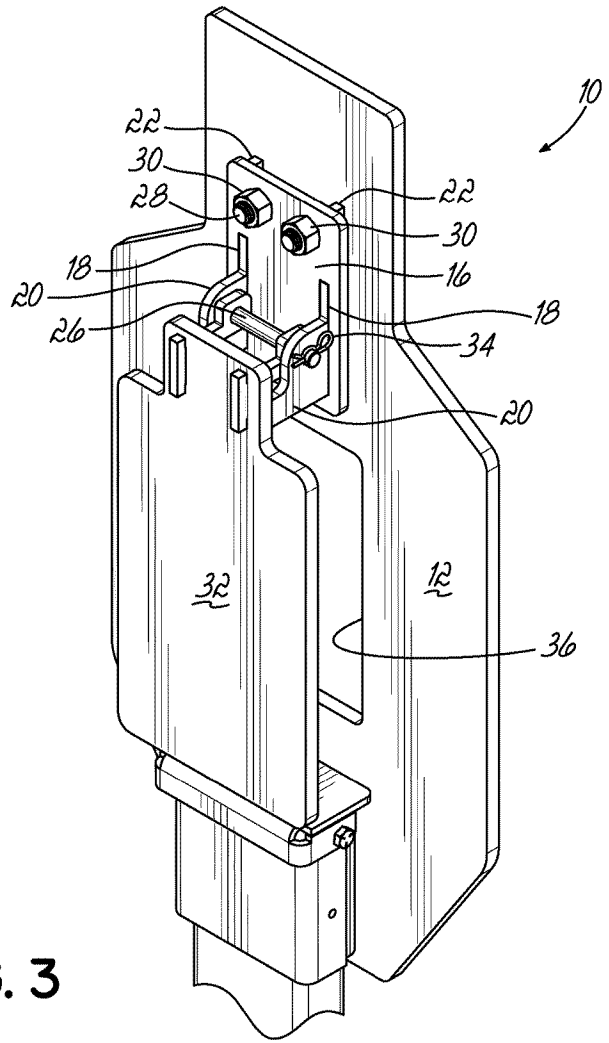
FIG. 3 is another isometric assembled view thereof.

Referring now also to FIGS. 2 and 3, a displaceable target panel 32 may be pivotally attached to and supported by the pivot plates 14 by the pivot axis means, in this case a clevis pin 26 inserted through respective openings and held in place by a cotter key or hair pin clip 34. In this illustrated example, bullets fired at the target 10 may impact the front plate 12 or may pass through a window 36 in the front plate 12 to strike and temporarily displace the target panel 32. After impact, the target panel 32 pivots back to its original position by gravity.

Figure 4:
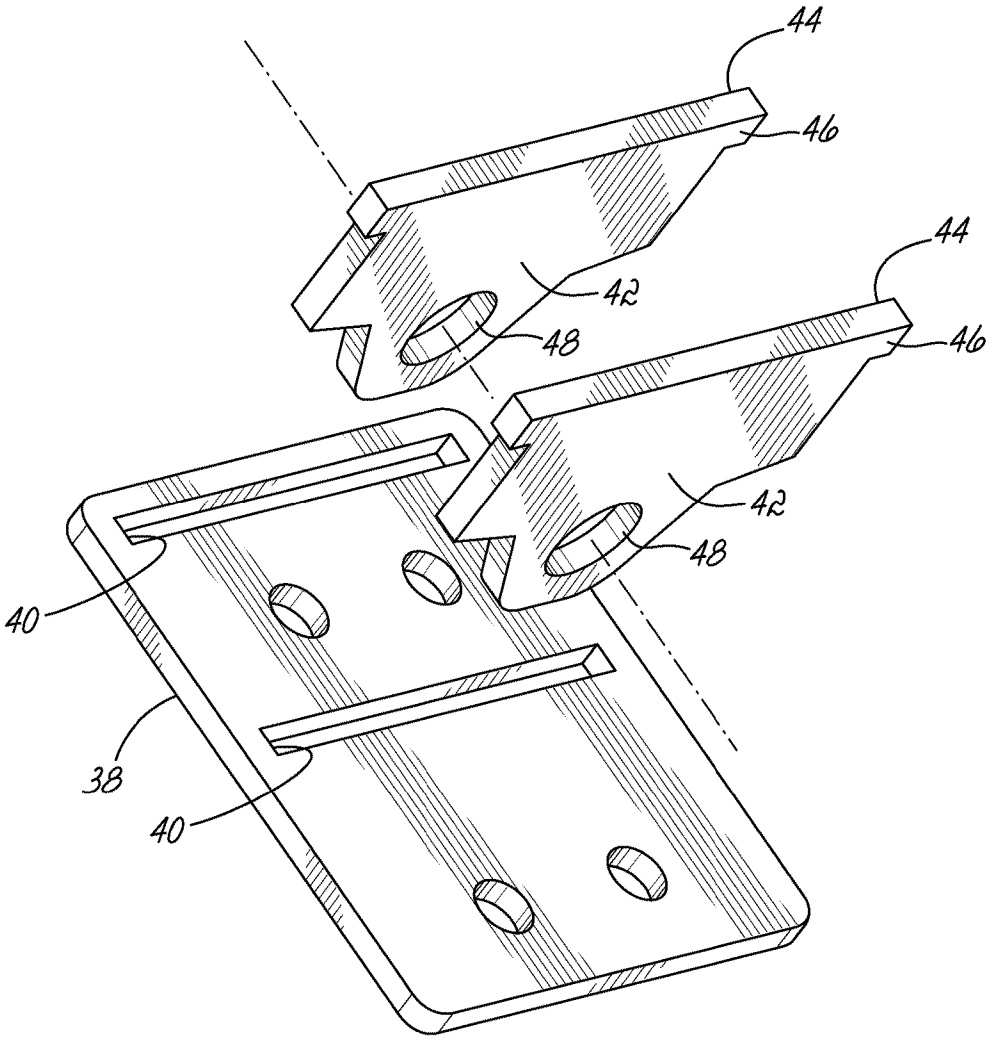
FIG. 4 is an exploded isometric view showing a part of a second embodiment of the present invention.
Figure 5:
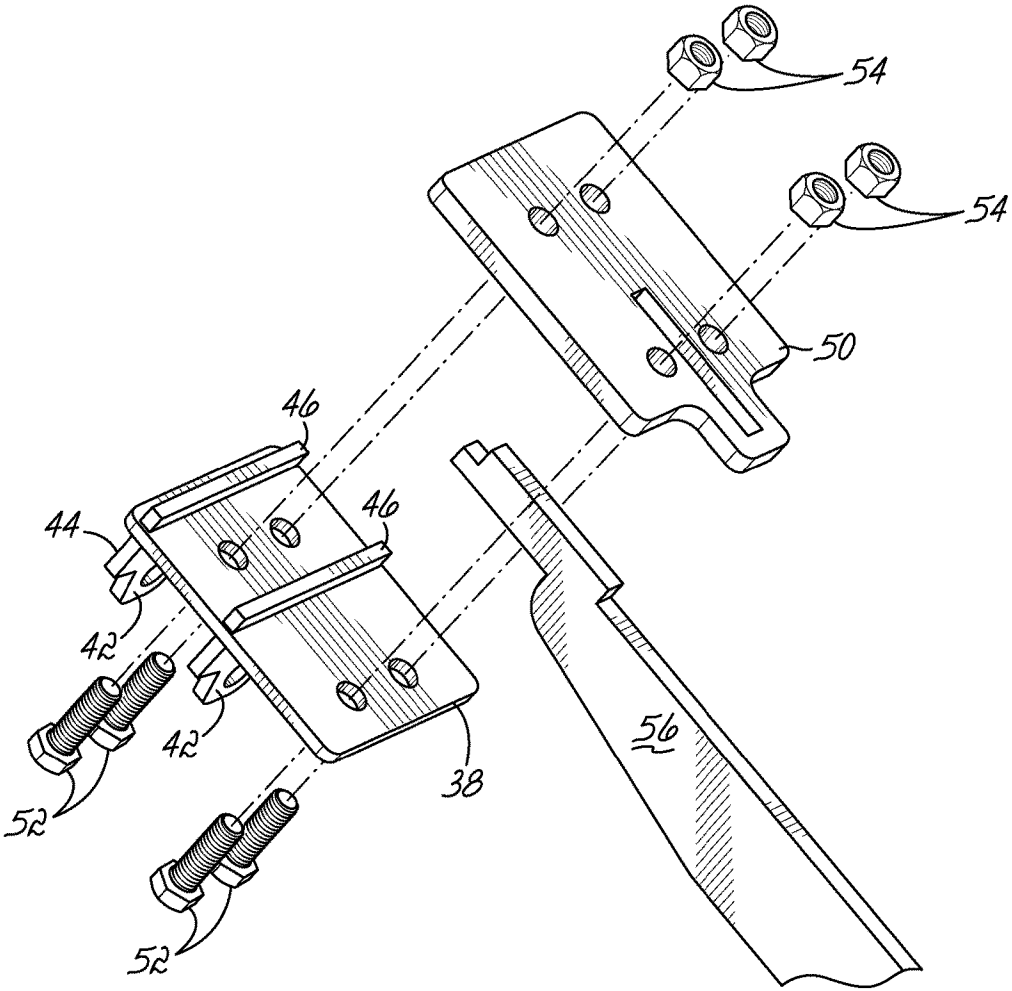
FIG. 5 is another isometric exploded view thereof showing assembly of this embodiment.

Referring now to FIGS. 4 and 5, another embodiment of the present invention is shown which provides a substantially vertical pivot axis for a displaceable target paddle. As shown in FIG. 4, a base plate 38 is provided with a pair of spaced apart elongated slots 40. The slots 40 receive extension portions 42 of a pair of pivot plates 44. The pivot plates 44 also include an elongated base portion 46 that is sized not to fit through the slot 40. The extension portions 42 each include an opening 48 the is axially aligned with the other when the pivot plates 44 are assembled to the base plate 38.

Referring now also to FIG. 5, after the pivot plates 44 have been inserted through the elongated slots 40 in the base plate 38, the base portions 46 are sandwiched in place by clamping the base plate 38 to a clamp plate 50. These may be clamped, for example, by a series of bolts 52 and nuts 54. A support or mounting post 56 may also be clamped between the base plate 38 clamp plate 50 to support the pivot assembly.

Figure 6:
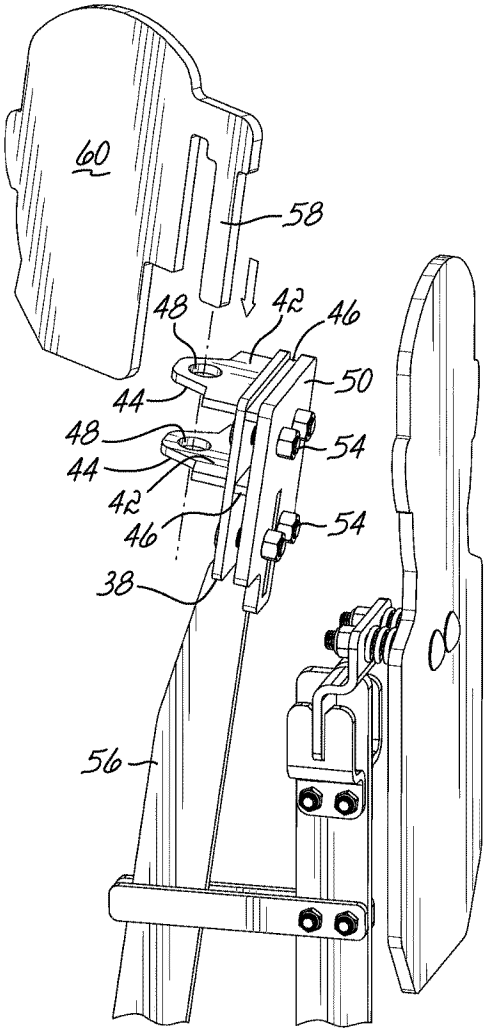
FIG. 6 is an isometric view showing an insertion of a swinging target paddle into the pivot assembly.

Referring now to FIG. 6, the openings 48 provide a pivot axis means that can receive a pivot pin portion 58 of a target paddle 60, allowing the target paddle 60 to pivot between first and second, left and right positions when impacted by a bullet. The parts of the pivot assembly, in particular the clamp plate 50 that may be exposed to bullet impact, are securely assembled without welding or bending any of the hardened steel parts.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. In a bullet impact target, a pivot support assembly, comprising:

a first plate;

a second plate having a pair of spaced-apart elongated slots formed therein;

a pair of pivot support plates each having an extension portion sized to extend through one of the elongated slots and a base portion sized not to fit through the slot, each of the extension portions including a pivot axis means; and a clamp means for securing the first and second plates together in a substantially parallel relationship, wherein, the extension portions of the pivot support plates are positioned through the slots such that the pivot axis means of each are substantially axially aligned with each other, the base portion is clamped between the first and second plates, and a bullet resistant target plate is supported for pivotal movement on the pivot axis means.

2. The pivot support assembly of claim 1, wherein the pivot axis means includes axially aligned openings.

3. The pivot support assembly of claim 2, wherein the target plate is supported on an axle that extends through the axially aligned openings.

4. The pivot support assembly of claim 1, wherein the clamp means includes a plurality of threaded fasteners extended through openings in the first and second plates.

5. The pivot support assembly of claim 1, wherein the first plate is a bullet impact panel made of hardened steel.

6. The pivot support assembly of claim 1, further comprising a mounting support member having a portion that is clamped between the first and second plates.

* * * * *